US008124228B2

(12) United States Patent
Yoshikawa et al.

(10) Patent No.: US 8,124,228 B2
(45) **Date of Patent: *Feb. 28, 2012**

(54) CARBON FIBER STRAND AND PROCESS FOR PRODUCING THE SAME

(75) Inventors: Hidekazu Yoshikawa, Shizuoka (JP); Taro Oyama, Shizuoka (JP); Hiroshi Kimura, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 43 days.

This patent is subject to a terminal disclaimer.

(21) Appl. No.: 12/740,011

(22) PCT Filed: Aug. 27, 2008

(86) PCT No.: PCT/JP2008/065316

§ 371 (c)(1),
(2), (4) Date: Apr. 27, 2010

(87) PCT Pub. No.: WO2009/060653

PCT Pub. Date: May 14, 2009

(65) Prior Publication Data

US 2010/0252438 A1 Oct. 7, 2010

(30) Foreign Application Priority Data

Nov. 6, 2007 (JP) ..... 2007-288169

(51) Int. Cl.
*D02G 3/00* (2006.01)

(52) U.S. Cl. ..... 428/367; 205/50; 423/447.1

(58) Field of Classification Search ..... 428/367; 423/447.1, 447.2; 205/50, 159
See application file for complete search history.

(56) References Cited

U.S. PATENT DOCUMENTS

| | | | | |
|---|---|---|---|---|
| 5,078,840 | A * | 1/1992 | Ogawa et al. | 205/768 |
| 5,356,707 | A * | 10/1994 | McCullough et al. | 428/367 |
| 5,582,912 | A * | 12/1996 | McCullough et al. | 428/367 |
| 7,638,110 | B1 * | 12/2009 | Yoshikawa et al. | 423/447.2 |
| 2005/0271874 | A1 * | 12/2005 | Sakajiri et al. | 428/364 |
| 2010/0252438 | A1 * | 10/2010 | Yoshikawa et al. | 205/50 |

(Continued)

FOREIGN PATENT DOCUMENTS

| | | | |
|---|---|---|---|
| JP | 1025627 | A | 1/1989 |

(Continued)

*Primary Examiner* — N. Edwards
(74) *Attorney, Agent, or Firm* — Norris McLaughlin & Marcus P.A.

(57) ABSTRACT

A carbon fiber strand which is produced by obtaining a solidified-yarn strand by spinning with a spinneret having 20,000-30,000 spinning holes, passing the strand through an interlacing nozzle having an air blowing pressure of 20-60 kPa to obtain precursor fibers, oxidizing them in heated air having a temperature of 200-280° C. to obtain oxidized fibers, subjecting these oxidized fibers to a first carbonization treatment in an inert-gas atmosphere at a temperature of 300-900° C. in which the fibers are firstly stretched in a stretch ratio of 1.03-1.06 and then secondarily stretched in a stretch ratio of 0.9-1.01, subsequently conducting a second carbonization treatment in an inert-gas atmosphere at 1,360-2,100° C., and then conducting a surface oxidization treatment in an aqueous solution of an inorganic acid salt in a quantity of electricity of 20-100 C per g of the carbon fibers. This carbon fiber strand has a strand tensile strength of 5,650 MPa or higher, strand tensile modulus of 300 GPa or higher, and strand width of 5.5 mm or larger. No strand crack is observed in an examination by a strand crack evaluation method.

3 Claims, 7 Drawing Sheets

U.S. PATENT DOCUMENTS

2010/0252439 A1* 10/2010 Yoshikawa et al. ..... 205/50

FOREIGN PATENT DOCUMENTS

| | | | |
|---|---|---|---|
| JP | 2002327339 | A | 11/2002 |
| JP | 2003064539 | A | 3/2003 |
| JP | 2003306836 | A | 10/2003 |
| JP | 2004107836 | A | 4/2004 |
| JP | 2004285501 | A | 10/2004 |
| JP | 2005133274 | A | 5/2005 |
| JP | 2005314830 | A | 11/2005 |
| JP | 2006183173 | A | 7/2006 |
| WO | 2005078173 | A1 | 8/2005 |

* cited by examiner

CARBON FIBER STRAND AND PROCESS FOR PRODUCING THE SAME

TECHNICAL FIELD

The present invention relates to a carbon fiber strand as a bundling of 20,000 or more single fibers, and a manufacturing process therefor. The carbon fiber strand has a feature that the strand is resistant to splitting into a plurality of strands during fiber opening.

BACKGROUND ART

Carbon fibers are generally produced by a well-known process where raw fibers (precursor fibers) such as polyacrylonitrile (PAN) are oxidized and carbonized to give carbon fibers. The carbon fibers thus obtained have excellent properties such as high strength and high elastic modulus.

Composite materials (for example, carbon fiber reinforced plastic (CFRP)) produced utilizing carbon fibers have been used for increasing applications. For example, in the fields of sports/leisure, aerospace and automobiles, (1) improved performance (improvement in strength and elasticity) and (2) weight reduction (weight reduction of fibers and reduction of a fiber content) have been required in a composite material. For meeting these requirements, there has been needed carbon fibers which can give a composite material exhibiting improved physical properties by combining carbon fibers and a resin (matrix material).

For providing a high-performance composite material, physical properties of the matrix material are important. Improving the surface properties, strength and an elastic modulus of carbon fibers is also important. Generally, it is important to combine a matrix material and carbon fibers having a carbon fiber surface exhibiting high adhesiveness to the matrix material, and to adequately uniformly disperse the carbon fibers in the matrix material. Thus, a higher-performance composite material can be provided.

There have been investigations for surface crease, surface properties, strength and an elastic modulus of carbon fibers (for example, see Patent References Nos. 1 to 4).

In producing carbon fibers, a spinneret having more spinning holes is more suitable for large-scale production. However, a precursor fiber strand produced by spinning from a spinneret having 20,000 or more spinning holes has higher fiber-opening tendency, if nothing is done. Therefore, when a carbon fiber strand is produced using such a precursor fiber strand as a raw material, fiber opening excessively proceeds during the oxidation and the carbonization steps described later to provide a carbon fiber strand exhibiting inconsistent physical properties.

When a large amount of a sizing agent is added for controlling an extent of fiber opening, particularly in the carbonization step, there generate a large amount of impurities derived from the sizing agent, leading to a highly uneven carbon fiber strand, so that a carbon fiber strand with high strength and a high elastic modulus cannot be provided.

To avoid the above problems, there is proposed a process for producing a precursor strand consisting of 20,000 or more single fibers by bundling a plurality of precursor strands spun using a spinneret having a relatively smaller number of spinning holes.

An example is thought of production of a carbon fiber strand as a bundle of 24,000 single fibers. Generally, a precursor strand consisting of 3,000 to 12,000 single fibers can be provided using one spinneret. Two to eight of the precursor strands can be collected into a precursor strand consisting of 24,000 single fibers, which can be then oxidized and carbonized to give a carbon fiber strand consisting of 24,000 single fibers. Alternatively, each of the precursor strands can be directly oxidized and then, the individual strands can be collected during the subsequent carbonization to give a carbon fiber strand consisting of 24,000 single fibers. Alternatively, each of the precursor strands can be directly oxidized and then carbonized before collecting the individual strands to give a carbon fiber strand consisting of 24,000 single fibers.

However, when a composite material is produced using carbon fiber strands prepared as described above, fiber opening of the collected carbon fiber strands for resin impregnation substantially causes separation of these into the original strands, which is so-called strand splitting.

Since each carbon fiber constituting a collected strand is not prepared from a single spinneret, its properties such as strength tends to significantly vary.

As described above, in a carbon fiber strand consisting of 20,000 or more single fibers prepared by collecting a plurality of strands, strand splitting tends to occur during fiber opening and physical properties of each carbon fiber constituting a strand are inconsistent. Furthermore, since physical properties of each carbon fiber constituting a strand are inconsistent, a strand tensile strength and a strand tensile modulus of the carbon fiber are generally low.

Generally, for producing a composite material, a carbon fiber strand is adequately fiber-opened and then, uniformly impregnated with a matrix resin. When strand splitting occurs during fiber opening of the carbon fiber strand, impregnation with the resin becomes uneven, leading to deterioration in physical properties of the composite material obtained. Therefore, the feature required for a carbon fiber strand suitable for manufacturing a composite material is adequate fiber opening without causing strand splitting.

Patent Reference No. 1: Japanese published unexamined application No. 1998-25627 (Claims).

Patent Reference No. 2: Japanese published unexamined application No. 2006-183173 (Claims).

Patent Reference No. 3: Japanese published unexamined application No. 2005-133274 (Claims).

Patent Reference No. 4: Japanese published unexamined application No. 2002-327339 (Claims).

DISCLOSURE OF INVENTION

Technical Problem

The inventors have intensely conducted investigation for solving the above problems. Finally, we have found that a carbon fiber strand which is easily fiber-opened while being resistant to strand splitting can be provided by interlacing a precursor fiber strand prepared using spinnerets having 20,000 or more spinning holes per one spinneret under predetermined conditions followed by predetermined oxidation, carbonization and surface oxidation. As a result of the above investigation, the present invention has been achieved.

An objective of the present invention is to provide a carbon fiber strand in which the above problems are solved and a production process therefor.

Technical Solution

The present invention which can achieve the above objective has the following aspects.

[1] A carbon fiber strand comprising a bundle of 20,000 to 30,000 carbon fibers, in which as measured by scanning probe microscopy, an inter-crease distance in the surface of said carbon fiber is 100 to 119 nm, a crease depth in the surface is 23 to 30 nm, an average fiber diameter is 4.5 to 6.5 μm, a specific surface area is 0.6 to 0.8 $m^2/g$ and a density is 1.76 $g/cm^3$ or more, wherein said carbon strand has a strand tensile strength of 5,650 MPa or more and a strand tensile modulus of 300 GPa or more; a strand wound with a predetermined tension has a strand width of 5.5 mm or more; and no strand splittings are observed in a strand splitting evaluation method where a predetermined tension is applied to a running carbon fiber strand.

[2] A process for producing the carbon fiber strand as described in [1], comprising passing a solidified-yarn strand prepared by spinning a stock spinning solution using a spinneret having 20,000 to 30,000 spinning holes through an interlacing nozzle at a pressurized-air blowing pressure of 20 to 60 kPa as a gauge pressure to provide a precursor fiber strand; then oxidizing said precursor fiber strand in hot air at 200 to 280° C. to provide an oxidized fiber strand; conducting first carbonization by first stretching said oxidized fiber strand with a stretch ratio of 1.03 to 1.06 at a temperature of 300 to 900° C. in an inert-gas atmosphere and then second stretching with a stretch ratio of 0.9 to 1.01; then, conducting second carbonization at a temperature of 1,360 to 2,100° C. in an inert-gas atmosphere; and then, oxidizing the surface of the carbon fiber strand obtained after said carbonization, by electrolytic oxidation with an electric quantity of 20 to 100 C per 1 g of the carbon fibers in an aqueous solution of an inorganic acid salt.

[3] The process for producing a carbon fiber strand as described in [2], wherein said stock spinning solution is an aqueous solution of zinc chloride or a solution of an acrylic polymer in an organic solvent.

Advantageous Effect

The carbon fiber strand of the present invention is produced using a precursor strand derived from a single spinneret, so that it is resistant to strand splitting during fiber opening in spite of the fact that it consists of 20,000 or more single fibers. Therefore, in producing a composite material, the strand can be largely opened to be impregnated with a resin. As a result, a composite material having good physical properties can be prepared. Furthermore, since each single fiber in the carbon fiber strand is prepared using a single spinneret, variation in physical properties is small between the single fibers. Thus, a strand tensile strength and a strand tensile modulus of the carbon fiber strand are higher than those for a conventional carbon fiber strand consisting of 20,000 or more single fibers prepared by collecting a plurality of strands.

The carbon fibers constituting the carbon fiber strand have an inter-surface-crease distance, a depth and a specific surface area within predetermined ranges, and therefore, exhibits good adhesiveness to a matrix resin.

The process for producing a carbon fiber strand of the present invention is suitable for a large-scale production because a precursor fiber strand can be formed using a spinneret having 20,000 or more spinning holes.

EXPLANATION OF REFERENCE

Figure 1:
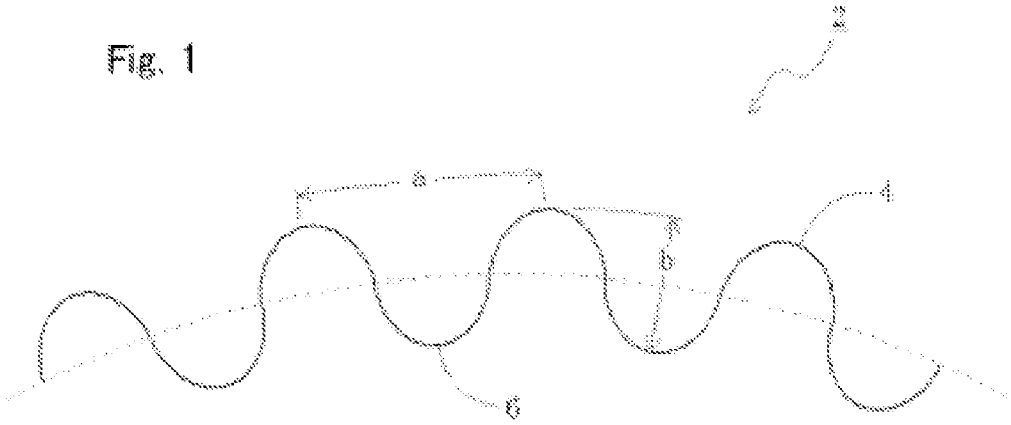
FIG. 1 is a schematic partial cross sectional view illustrating an example of a carbon fiber constituting a carbon fiber strand of the present invention.

The symbols have the following meanings; 2: carbon fiber, 4: peak in a waveform, 6: trough in a waveform, a: inter-peak distance (inter-crease distance), b: difference in height between a peak and a trough (crease depth), 12: interlacing nozzle, 14: precursor fiber, 16: pressurized-air inlet, 18: pressurized-air, and 20: air flow.

BEST MODE FOR CARRYING OUT THE INVENTION

There will be detailed the present invention.

A carbon fiber strand of the present invention consists of a bundle of 20,000 to 30,000, preferably 20,000 to 26000 single fibers (carbon fibers).

A strand tensile strength of this carbon fiber is 5,650 MPa or more, preferably 5,680 MPa or more. Although there is not a preferable upper limit, the upper limit is generally about 5,700 MPa. A strand tensile modulus of this carbon fiber is 300 GPa or more, preferably 308 to 370 GPa. Herein, sometimes in the specification, a strand tensile strength of a carbon fiber is simply called "strength", and a strand tensile modulus of a carbon fiber is simply called "elastic modulus".

This carbon fiber strand has a strand width of 5.5 mm or more, preferably 6 to 10 mm, more preferably 6 to 8 mm as determined by a strand width measuring method described below. Furthermore, in this carbon fiber strand, no strand splittings are observed in a strand splitting evaluation method described below.

In the surfaces of the carbon fibers (single fibers) constituting a carbon fiber strand of the present invention, there are formed a plurality of creases in the same direction as a fiber-axis direction.

A specific surface area of a carbon fiber as determined by the measuring method described below is 0.6 to 0.8 $m^2/g$.

A density of a carbon fiber is 1.76 $g/cm^3$ or more, preferably 1.76 to 1.80 $g/cm^3$.

An average diameter of a carbon fiber is 4.5 to 6.5 μm, preferably 5.0 to 6.0 μm.

FIG. 1 is a schematic partial cross sectional view illustrating an example of a carbon fiber constituting a carbon fiber strand of the present invention. FIG. 1 shows a cross section of a carbon fiber taken on a plane perpendicular to a carbon fiber axis. The surface of a carbon fiber 2 of this example has a crease formed by fluctuation in a carbon fiber diameter along the circumferential direction of the fiber. In FIG. 1, "4"

indicates a peak having a larger diameter. Then, "6" is a trough having a smaller diameter.

Then, "a" indicates an inter-peak distance (crease distance). Then, "b" indicates a difference in height between a peak and a trough (crease depth). A crease distance "a" and a crease depth "b" can be measured by scanning probe microscopy. Scanning probe microscopic observation of the surface of a carbon fiber indicates a crease distance "a"=100 to 119 nm and a surface crease depth "b"=23 to 30 nm.

A carbon fiber strand of the present invention can be prepared, for example, by the following method.

Stock Spinning Solution

A starting material for producing a carbon fiber strand of the present invention is a stock spinning solution for producing a precursor fiber. A stock spinning solution can be any known stock spinning solution for producing a carbon fiber without any restriction. Among them, preferred is a stock spinning solution for producing an acrylic carbon fiber. Specifically, preferred is a stock spinning solution prepared by homopolymerizing an acrylonitrile monomer or copolymerizing acrylonitrile monomer in 90% by weight or more, preferably 95% by weight or more with other monomers. Examples of another monomer which is copolymerized with acrylonitrile include acrylic acid, methyl acrylate, itaconic acid, methyl methacrylate and acrylamide.

A stock spinning solution is preferably an aqueous solution of zinc chloride or a 5 to 20% by weight solution of the above acrylonitrile polymer in an organic solvent such as dimethylformamide (DMF) and N,N-dimethylacetamide (DMAc).

Spinning

A stock spinning solution is ejected from a spinneret having 20,000 to 30,000, preferably 20,000 to 26000 spinning holes per spinneret. A stock spinning solution ejected from a spinning hole can be solidified by, for example, wet spinning, dry-wet spinning and dry spinning. Wet spinning is a method where the stock spinning solution ejected from a spinneret is directly fed into a solidification bath filled with a solidification liquid (a mixture of a solvent used in producing a stock spinning solution and water) cooled to a low temperature. Dry-wet spinning is a method where first, a stock spinning solution is ejected from a spinneret to the air, passes through an about 3 to 5 mm space and is then fed to a solidification bath.

By wet spinning, a fine crease is spontaneously formed in the surface of the carbon fiber obtained finally. In terms of the size of the crease, the crease distance "a" is 100 to 119 nm and the surface crease depth "b" is about 23 to 30 nm. The presence of such a crease can lead to improved adhesiveness of a carbon fiber to a resin in producing a composite material. A spinning method is, therefore, preferably wet spinning. Here, the spinning hole generally has a perfect circular shape. In dry spinning, a crease can be formed, for example, by modifying the shape of the spinning hole or adjusting the spinning conditions.

Then, the solidified acrylic fibers are appropriately subjected to common processing such as washing with water, drying and stretching.

In the above spinning step, it is preferable to add an oil to an acrylic fiber or the like for improving heat resistance and/or stable spinning. The oil is preferably a known oil as a combination of a permeable oil having a hydrophilic group and a silicone oil.

Interlacing

In the spinning step, tangling (entanglement) occurs between a number of precursor fiber yarns constituting a precursor fiber strand or temporal adhesion occurs due to oiling. Furthermore, excessive fiber opening may occur. These lead to generation of fluff and breakage of a precursor fiber. To avoid these problems, interlacing is conducted. Interlacing partially detangles a strand, achieving appropriate entanglement before fiber opening.

Figure 2:
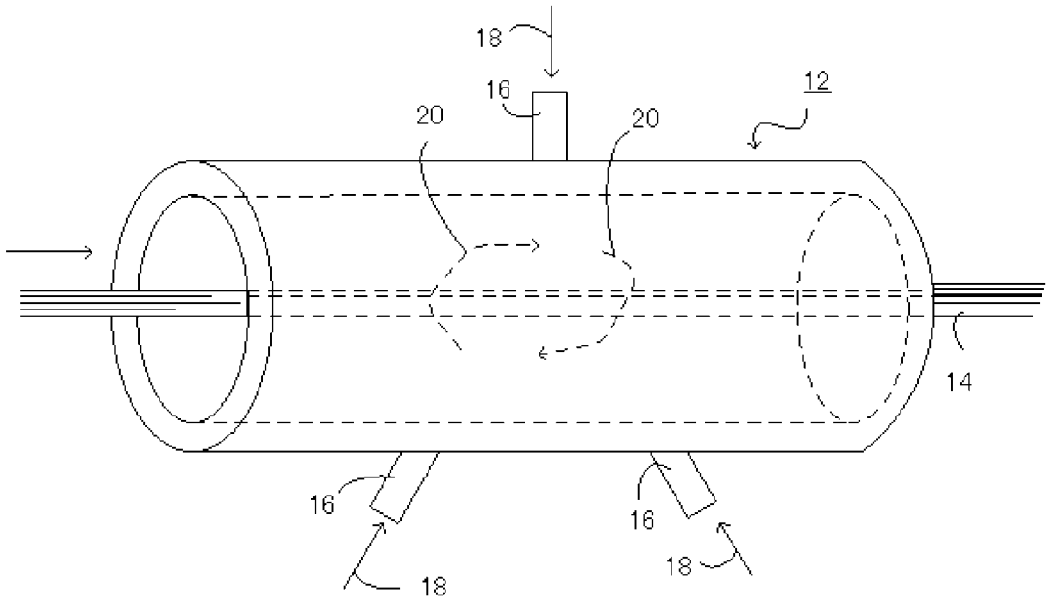
FIG. 2 is a conceptual view illustrating an example of an interlacing nozzle used in a process for producing a carbon fiber strand of the present invention.

Interlacing is conducted by letting a precursor fiber strand pass through an interlacing nozzle, for example, shown in FIG. 2.

In FIG. 2, "12" is an interlacing nozzle. A precursor fiber strand 14 passes through the inside of a cylindrical main body 12*a* constituting the interlacing nozzle 12. The interlacing nozzle 12 has a plurality of (three in this figure) pressurized-air inlets 16 penetrating the cylindrical main body 12*a*. Pressurized-air 18 is fed into the cylindrical main body 12*a* through the pressurized-air inlets 16. The pressurized-air fed generates air flow 20 within the cylindrical main body 12*a*. A pressurized-air blowing pressure is kept at 20 to 60 kPa as a gauge pressure.

When the pressurized-air blowing pressure is less than 20 kPa, entanglement between precursor fibers in the precursor fiber strand generated during the spinning step is eliminated and the precursor fiber strand is fiber-opened.

When an inner pressure is 20 to 60 kPa, fiber opening and entanglement occur in a proper degree, resulting in improvement in convergence of a precursor fiber strand.

A pressurized-air blowing pressure of more than 60 kPa leads to excessive entanglement in a precursor fiber strand, resulting in damage to the precursor fibers and finally deterioration in strand strength. In this interlacing, a pressurized-air blowing pressure is adjusted within the proper range described above (20 to 60 kPa as a gauge pressure), to achieve proper fiber opening and entanglement in a strand without an damage in fibers.

Oxidation

The precursor fibers thus interlaced are then oxidized in hot air at 200 to 280° C. The oxidation causes, when a precursor fiber is an acrylic fiber, an intra-molecular cyclization reaction, resulting in increase in an oxygen binding amount. As a result, the precursor fibers are made melting resistant and flame retardant to provide acrylic oxidized fibers (OPF).

In oxidation, stretching is made generally with a stretch ratio of 0.85 to 1.30. For providing a carbon fiber with high strength and a high elastic modulus, a stretch ratio is preferably 0.95 or more. The above oxidation provides oxidized fibers with a density of 1.3 to 1.5 g/cm$^3$.

First Carbonization

In the first carbonization step of this process for producing carbon fibers, the oxidized fibers undergo, in an inert atmosphere, the first stretching with a stretch ratio of 1.03 to 1.06 while being heated within a temperature range of 300 to 900° C. Then, the first-stretched oxidized fibers undergo the second stretching with a stretch ratio of 0.9 to 1.01 within the temperature range of 300 to 900° C. in an inert atmosphere to give first-carbonized fibers with a fiber density of 1.50 to 1.70 g/cm$^3$.

First Stretching in the First Carbonization Step

In the first carbonization step, the oxidized fibers are gradually heated from a low temperature of 300° C. to a high temperature (900° C.) within the above temperature range. In this step, an elastic modulus, a density, a crystallite size and the like described in (1) to (3) below vary.

In the first stretching in the first carbonization step, the oxidized fibers were heated and when the oxidized fiber is within the following range, stretching is conducted with a stretch ratio of 1.03 to 1.06 in total:

(1) the range from the point where an elastic modulus of the oxidized fibers is reduced to a minimal value to the point where it increases to 9.8 GPa;

(2) the range to the point where a density of the fibers reaches 1.5 g/cm$^3$; and (3) the range to the point where a crystallite size of the fibers reaches 1.45 nm as determined by wide-angle X-ray measurement (diffraction angle: 26)°.

Figure 3:
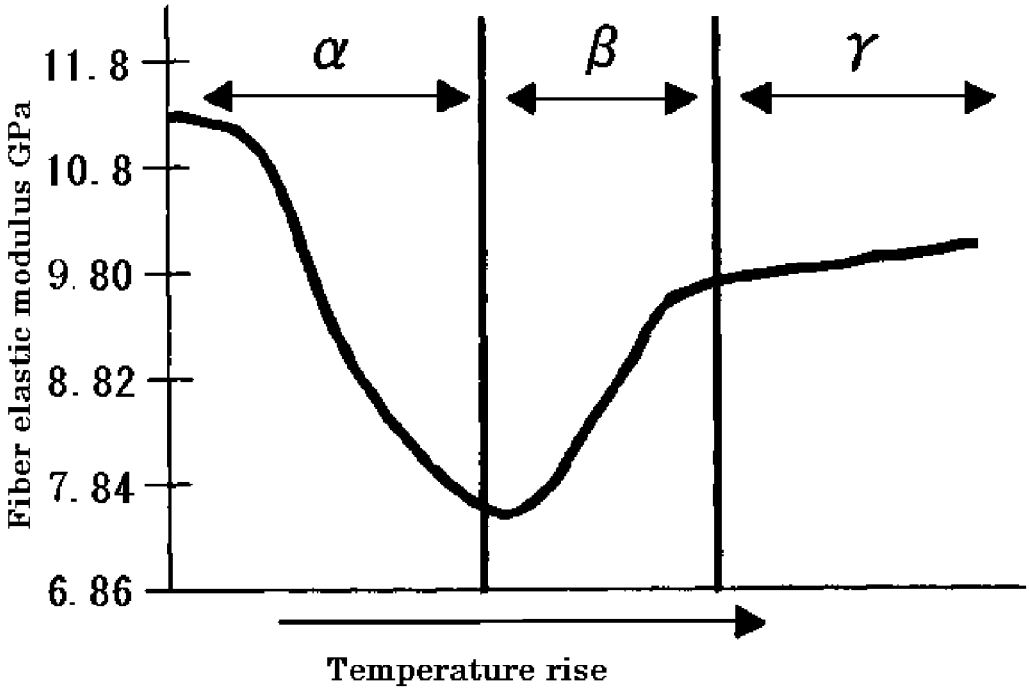
FIG. 3 is a graph showing change of an elastic modulus in PAN oxidized fibers to temperature increase during the first stretching in the first carbonization step.

The temperature range from the point where an elastic modulus of the oxidized fibers is reduced to a minimal value to the point where an elastic modulus increases to 9.8 GPa is indicated as "β" in FIG. 3.

By the stretching (1.03 to 1.06 folds) within the range from the point where an elastic modulus of the oxidized fibers is reduced to a minimal value to the point where an elastic modulus increases to 9.8 GPa, a part with a low elastic modulus in the oxidized fiber is efficiently stretched while yarn break is prevented, to give highly oriented and dense first-stretched fibers.

Meanwhile, if the stretching is initiated with a ratio of 1.03 or more before an elastic modulus of the oxidized fibers is reduced to a minimum value (the range of "α"), yarn break increases, undesirably leading to significant deterioration in strength of the first-stretched fibers obtained.

If an elastic modulus of the fibers is reduced to a minimal value and then the stretching is initiated with a stretch ratio of 1.03 within the range after the elastic modulus reaches 9.8 GPa (the range "γ"), the fibers have a high elastic modulus, leading to forced stretching. As a result, defects and voids in the fibers increase, so that the stretching becomes ineffective. Thus, the first stretching is conducted within the above elastic modulus range.

By conducting the stretching (a ratio of 1.03 to 1.06) within the range to the point where a density of the oxidized fibers reaches 1.5 g/cm$^3$, orientation can be improved while preventing void formation, resulting in high-quality first-stretched fibers.

In contrast, if the first stretching is conducted with a ratio of 1.03 or more within the range where a density is more than 1.5 g/cm$^3$, voids are increased due to forcible stretching, disadvantageously leading to a structural defect and a low density in the finally obtained carbon fibers. Thus, the first stretching is conducted within the above density range.

If a stretch ratio during the first stretching is less than 1.03, the stretching is too ineffective to give high-strength carbon fibers. If the stretch ratio is more than 1.06, yarn break occurs and thus high-quality/high-strength carbon fibers cannot be obtained.

Second Stretching in the First Carbonization Step

Figure 4:
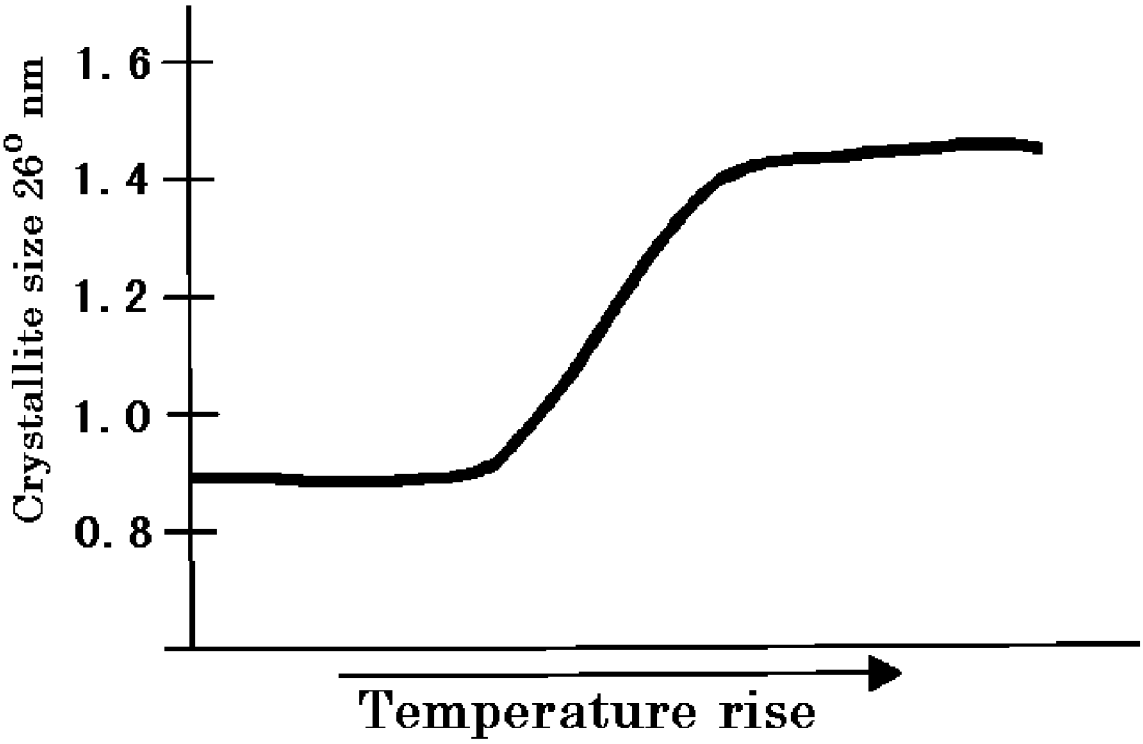
FIG. 4 is a graph showing change of a crystallite size in PAN oxidized fibers to temperature increase during the first stretching in the first carbonization step.

In the second stretching in the first carbonization, stretching is conducted with a stretch ratio of 0.9 to 1.01, under temperature rising, within (1) the range where a fiber density after the first stretching continues to increase during the second stretching and (2) the range where as shown in FIG. 4, a crystallite size of the fibers after the first stretching as determined by wide-angle X-ray measurement (diffraction angle: 26)° is 1.45 nm or less.

Figure 5:
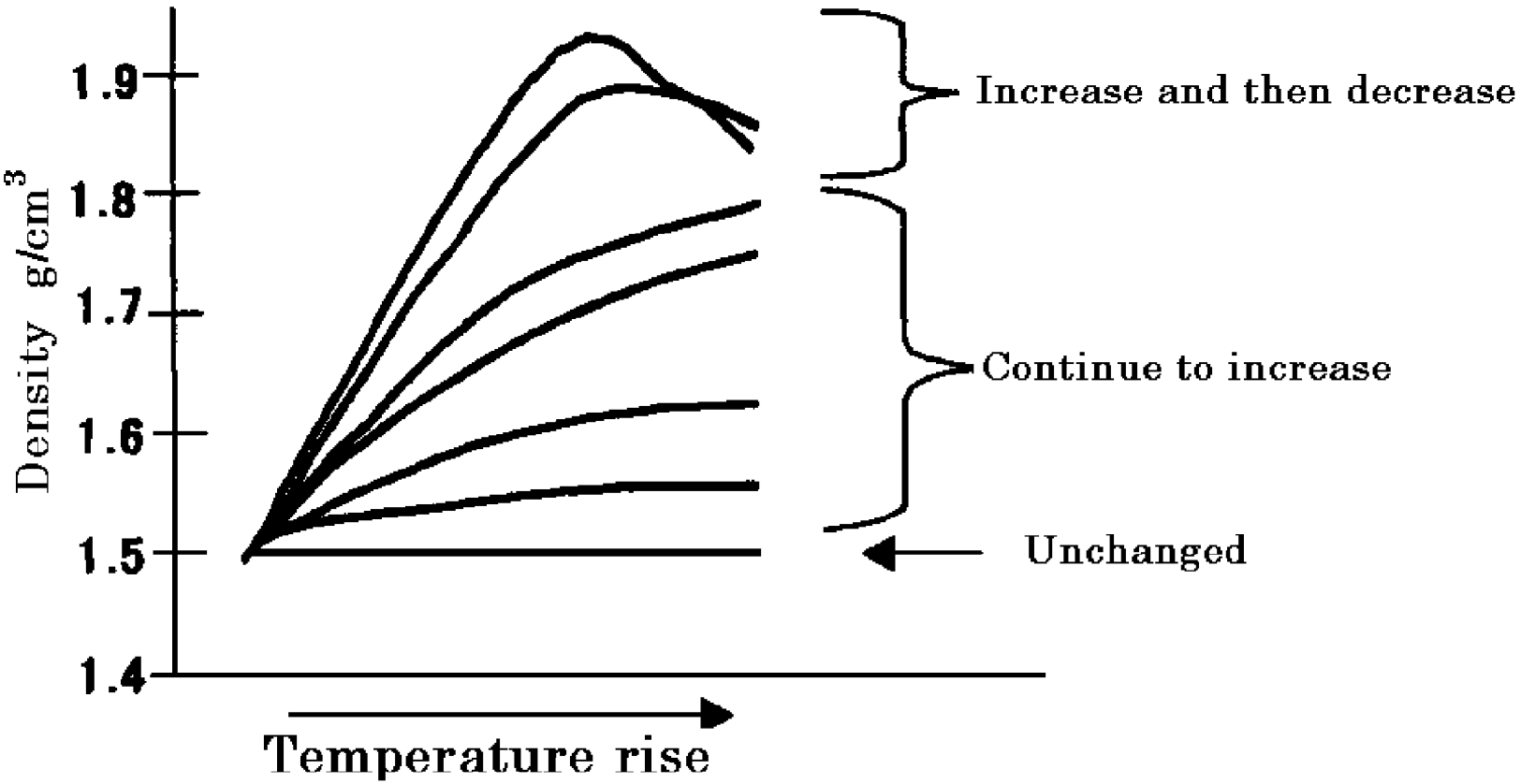
FIG. 5 is a graph showing change in a density of the first-stretched fiber to temperature increase during the second stretching in the first carbonization step.

During the second stretching in the first carbonization step, there are the conditions where a fiber density does not increase as a carbonization temperature rises, the conditions where it continues to increase and the conditions where it increases and then decreases, as shown in FIG. 5.

Among these conditions, under the conditions in which a density of the fibers after the first stretching continues to increase during the second stretching, stretching can be conducted with a stretch ratio of 0.9 to 1.01 to prevent void formation and finally to provide dense carbon fibers. The conditions in which the density continues to increase can be achieved by controlling the temperature condition of the carbonization.

In contrast, if the second stretching is conducted within the period where a fiber density decreases, void formation in the carbon fibers are accelerated, so that dense carbon fibers cannot be provided. If the second stretching involves the period where a fiber density is unchanged, the second stretching cannot be effective in improving denseness and thus finally, high-strength carbon fibers cannot be provided. The second stretching is, therefore, conducted within the range where a fiber density continues to increase.

Furthermore, the stretching is conducted with a stretch ratio of 0.9 to 1.01 within the range where a crystallite size of the fibers after the first stretching is 1.45 nm or less as determined by wide-angle X-ray measurement (diffraction angle: 26°). By this stretching, densification occurs without crystal growth and void formation is prevented to finally provide carbon fibers having improved denseness.

If the second stretching is conducted within the range where a crystallite size is more than 1.45 nm, voids increase in the fibers obtained. Furthermore, yarn break causes deterioration in fiber quality, and thus, high-strength carbon fibers cannot be provided. Therefore, the second stretching is conducted within the above crystallite size range.

If a stretch ratio is less than 0.9 in the second stretching, an orientation degree of the first-carbonized fibers is significantly deteriorated as determined by wide-angle X-ray measurement (diffraction angle 26°), and thus, high-strength carbon fibers cannot be obtained. If a stretch ratio is more than 1.01, yarn break occurs, so that high-quality and high-strength carbon fibers cannot be obtained. Therefore, a stretch ratio is preferably within the range of 0.9 to 1.01 during the second stretching.

For providing high-strength carbon fibers, the first-carbonized fibers preferably have an orientation degree of 76.0% or more as determined by wide-angle X-ray measurement (diffraction angle: 26°).

If the orientation degree is less than 76.0%, high-strength carbon fibers cannot be provided. For achieving the orientation degree of 76.0% or more, a stretch ratio in the step of making the oxidized fibers must be 0.95 or more, and as described above, the first carbonization step must be conducted under the predetermined conditions described above.

In the first carbonization step, the oxidized fibers undergo the first stretching and the second stretching to provide the first-carbonized fibers. In the first carbonization step, carbonization may be conducted in a series of processes or separately using one oven or two or more ovens.

Second Carbonization

In the second carbonization, the first-carbonized fibers obtained are stretched under an inert atmosphere within a temperature range of more than 900° C. to 2,100° C., preferably 1,360 to 2,100° C. to provide second-carbonization fibers. This step can be, if necessary, divided into a first and a second stretching steps.

For making the prepared carbon fibers have a required elastic modulus, a third carbonization step may be, if necessary, conducted after the second stretching in the second carbonization step for heating the carbon fibers. Furthermore, the second carbonization step and the heating as the post-process can be conducted in a series of steps or separately using one oven or two or more ovens.

First Stretching in the Second Carbonization Step

In the first stretching in the second carbonization step, the first-carbonized fibers obtained above are gradually heated from 1360° C. at an inlet of the oven toward 2100° C. at an outlet.

In this step, the fibers are stretched within the range meeting the following conditions during the temperature rising. A stretch ratio is appropriately determined within the range meeting the following conditions. A stretch ratio is generally within the range of 0.95 to 1.05.

(1) the range where a density of the fibers continues to increase, (2) the range where a nitrogen content in the fibers is kept at 10% by weight or more, and (3) the range where a crystallite size of the fibers is 1.47 nm or less as determined by wide-angle X-ray measurement (diffraction angle: 26°).

Figure 6:
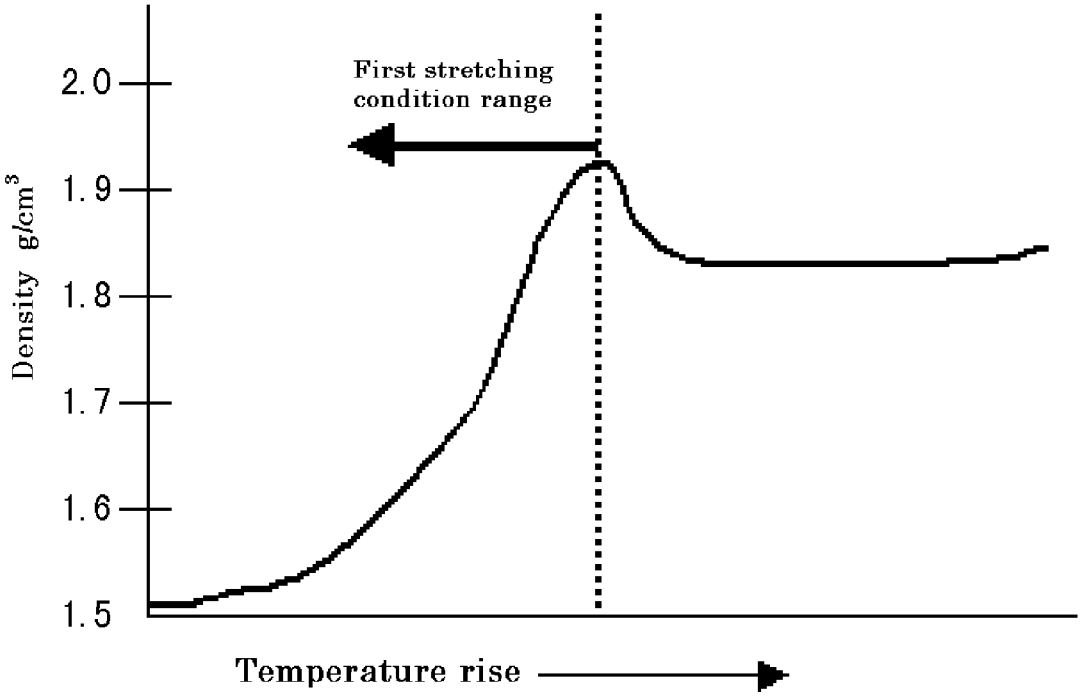
FIG. 6 is a graph showing change in a density of the first-carbonized fiber to temperature increase during the first stretching in the second carbonization step.
Figure 7:
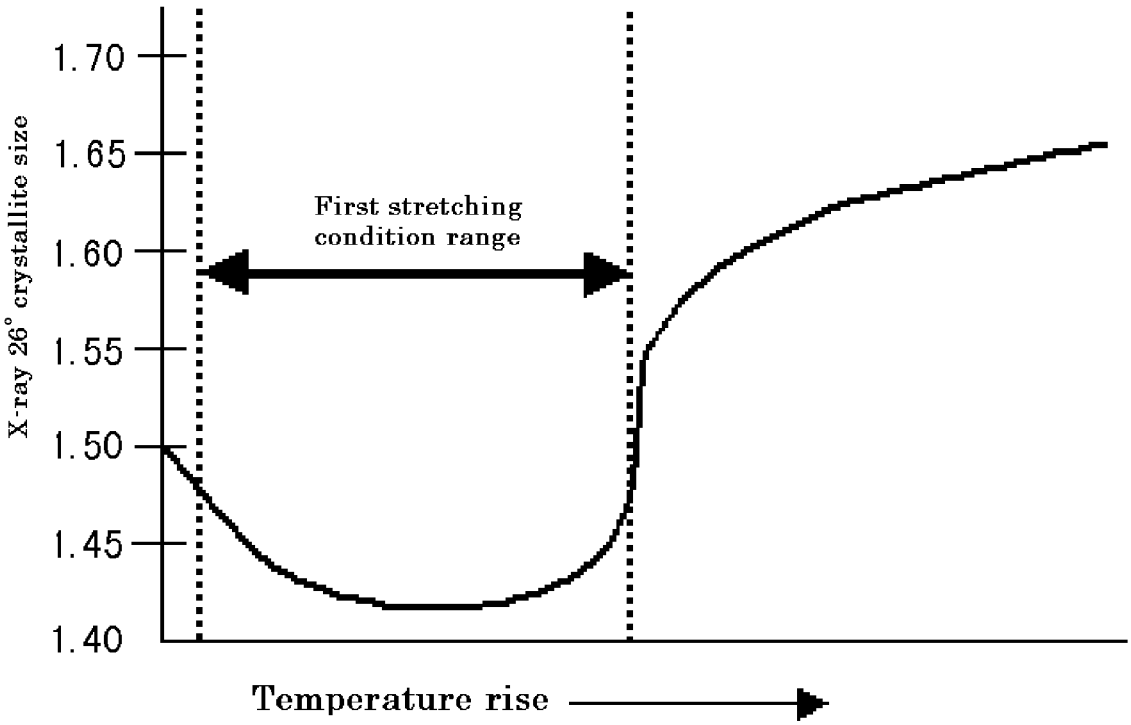
FIG. 7 is a graph showing change in a crystallite size in the first-carbonized fiber to temperature increase during the first stretching in the second carbonization step.

FIGS. 6 and 7 show, as an example, change in a density and a crystallite size for the first-carbonized fibers processed, in the first stretching in the second carbonization step. The range of the stretching condition is also shown.

In the first stretching in the second carbonization step, a fiber tension ("F", in MPa) varies, depending on a fiber cross-section area ("S", in $mm^2$) after the first carbonization step, and therefore, in the present invention, a fiber stress ("B", in mN) is used as a tension factor.

In the present invention, the fiber stress is within the range meeting the following formula:

$$1.24>B>0.46$$

wherein $B=F\times S$, $S=\pi D^2/4$, and

D is a diameter of the first-carbonized fiber (mm).

The fiber cross-section area is calculated by the following method. First, as defined in JIS-R-7601, a fiber diameter is measured with a repetition number n=20, using a micrometer microscope. Then, an average of the measured values of the fiber diameter is calculated. Using the average fiber diameter, an area of a perfect circle is calculated. The calculated area of a perfect circle is defined as a fiver cross-section area.

Second Stretching in the Second Carbonization

The first-stretched fibers obtained by the above method undergo the second stretching described below.

In this second stretching, the first-stretched fibers are stretched, during temperature rising, within the range where a density is unchanged or where the density decreases. A stretch ratio is generally within the range of 0.98 to 1.02.

Figure 8:
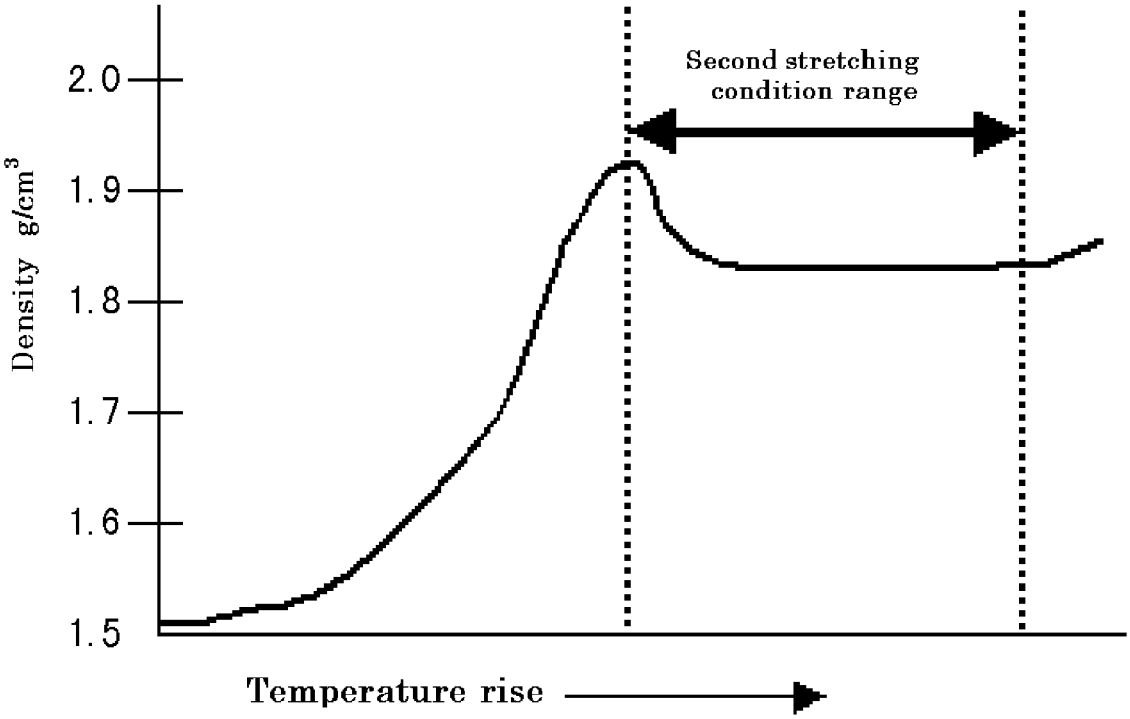
FIG. 8 is a graph showing change in a density of the first-stretched fiber to temperature increase during the second stretching in the second carbonization step.

FIG. 8 shows, as an example, change in a density of the first-stretched fibers in the second stretching and the condition range of the stretching.

In the second stretching in the second carbonization step, a tension ("H", in MPa) of the fibers also varies, depending on a fiber cross-section area ("S", in $mm^2$) after the first carbonization step. In the present invention, a tension factor is used as a fiber stress ("E", in mN). This fiber stress is within the range meeting the following formula:

$$2.80>E>0.23$$

wherein $E=H\times S$, $S=\pi D^2/4$, and

D is a diameter of the first-carbonized fiber (mm).

A diameter of the second-carbonized fiber is preferably 4 to 7 μm, more preferably 4.5 to 6.5 μm.

Surface Oxidation

The above second-carbonized fibers undergo surface oxidation. The surface oxidation is conducted in a gas or a liquid phase. Liquid-phase oxidation is preferable in the light of convenience in process management and productivity improvement. Among liquid-phase processes, electrolysis using an electrolytic solution is preferable in the light of safety and stability of a liquid. Preferable examples of an electrolyte used in the electrolytic solution include inorganic acid salts such as ammonium sulfate and ammonium nitrate. An electric quantity required for the electrolysis is preferably 20 to 100 coulomb (C) per 1 g of carbon fibers. If it is less than 20 C/g, the surface treatment becomes insufficient. In such a case, a surface crease depth is less than 23 nm and a specific surface area is less than 0.6 $m^2/g$, so that the surface state defined in the present invention cannot be achieved. If it is more than 100 C/g, fiber strength is reduced.

Sizing

The fibers after the surface oxidation are then, if necessary, sized. The sizing can be conducted by a known method. A sizing agent can be appropriately selected from known sizing agents, depending on an application. It is preferable to uniformly apply the sizing agent to the fibers and then to dry them. Examples of the sizing agent include known sizing agents such as epoxy compounds and urethane compounds.

Winding

The fibers after the optional sizing as appropriate are usually wound. The winding can be conducted by a known method. Generally, carbon fibers are wound on, for example, a bobbin under a tension of 9.8 to 29.4 N, and packaged.

The carbon fibers produced by the above method have a crease in the fiber surface, so that when being combined with a matrix material to provide a composite material, it exhibits good adhesiveness to the matrix material and acts as a good reinforcing material for the composite material. These carbon fibers are improved in a resin-impregnated strand strength, a resin-impregnated strand elastic modulus and a density while having little fluff and yarn break.

EXAMPLES

There will be further specifically described the present invention with reference to Examples and Comparative Examples. The processing conditions and the evaluation methods for the physical properties of precursor fibers, oxidized fibers and carbon fibers in Examples and Comparative Examples are as follows.

Density

A density for each fiber was determined by an Archimedes' method. A sample fiber was degassed in acetone before measuring a density.

Crystallite Size and Orientation Degree in Wide-Angle X-Ray Measurement (Diffraction Angle: 17° or 26°)

A X-ray diffractometer (Rigaku Corporation, RINT1200L) and a computer (Hitachi, Ltd., 2050/32) were used to obtain a diffraction pattern. Crystallite sizes at a diffraction angle of 17° and 26° were determined from a diffraction pattern. An orientation degree was determined from a half width.

Entanglement Degree of a Strand

A strand for measuring an entanglement degree was prepared and cut to provide five pieces of one-meter strand samples. One end of the sample was held while the other end of the sample was suspended. A jig which was a 20 g weight with a hook was hooked on the sample and the weight was left naturally dropping. The position in the sample at which the jig was hooked was 5 cm below from the upper end of the suspended sample and at the center in the sample width direction. A weight-dropping distance ("A" cm) was measured and an entanglement degree for each sample was calculated using the following equation.

Entanglement degree for each sample=100 cm/A cm.

With the measurement number n=5, an entanglement degree for each sample was determined, and an average of the measured values was calculated as an entanglement degree of the strand.

Elastic Modulus of a Single Fiber in the First-Stretched Fibers in the First Carbonization Step An elastic modulus of a single fiber in the first-stretched fibers of the first carbonization step was determined in accordance with the method defined in JIS R 7606 (2000).

Strand Tensile Strength and Strand Tensile Modulus of Carbon Fibers

Strand tensile strength and a strand tensile modulus was determined for the second-carbonized fibers in accordance with the method defined in JIS R 7601.

Method for Determining the Shape of Carbon Fibers

A crease depth in the carbon fiber surface (a difference in height between a peak and a trough) can be expressed by a square mean surface roughness. A carbon fiber for measurement was placed on a stainless-steel disk for measurement, and the sample was held by both ends on the disk, to prepare a measurement sample. Measurement was conducted for the sample in Tapping Mode using a scanning probe microscope (DI Company, SPM NanoscopeIII). The data thus obtained were subjected to quadratic curve correction using a bundled software, to determine a square mean surface roughness of the carbon fiber.

A crease distance in the carbon fiber surface (inter-peak distance) was measured using the same scanning probe microscope. Measurement was conducted for a square 2 μm area in the surface of the carbon fiber sample and the number of creases was counted from the shape image obtained. The measurement was repeated five times to determine the number of creases, and an average of the values was calculated. A crease distance was calculated from the average of the crease number thus obtained.

Specific Surface Area of Carbon Fibers

Using a specific surface area measuring apparatus [Yuasa Ionics Inc.; a full-automatic gas adsorption measuring apparatus AUTOSORB-1], a specific surface area of the carbon fibers was determined. One gram of the carbon fibers was taken and inserted into the measuring apparatus. Using krypton gas, measurement was conducted as usual, to obtain a specific surface area.

Evaluation Method for Strand Splitting in a Carbon Fiber Strand

Three stainless-steel bars (first to third bars) with a diameter of 15 mm (surface roughness: 150 count) were placed in parallel, separating from each other by a distance of 5 cm. A carbon fiber strand was placed on the three stainless-steel bars in a zig-zag manner. While a tension of 9.8 N was applied to the carbon fiber strand, the carbon fiber strand was slided from the first bar toward the third bar at 5 m/min. The strand sliding over the third bar was observed for 5 min, during which the presence of strand splitting, that is, splitting of the strand into a plurality of sub-strands, was evaluated.

Evaluation Method for a Carbon Fiber Strand Width

A carbon fiber strand width was evaluated by the following method. A carbon strand was wound on the bobbin with a tension of 9.8 N. A width of the strand on the bobbin was measured. A strand width was measured five times (n=5) at one-meter intervals in the length direction of the strand wound, and an average of these measured values was defined as a strand width.

Evaluation Method for Dry Fiber after Resin Impregnation

A strand tensile strength and a strand tensile elastic modulus were measured in accordance with the method defined in JIS R 7601, and then, a broken-out section of the sample used in the above test was observed by SEM (scanning electron microscopy). A fiber surface without a resin was regarded as dry fiber.

Evaluation Method for Process Stability of the Oxidation

In terms of process stability of the oxidation, the case where the frequency of strand break during the oxidation was one/24 hours or more was regarded as low process stability. The case with the frequency of less than 1/24 hours was regarded as high process stability.

Example 1

A stock spinning solution was ejected through a spinneret having 24,000 holes per spinneret into a 25% by weight aqueous solution of zinc chloride (solidification liquid). Thus, a solidified yarn was continuously prepared. The stock spinning solution was a copolymer prepared from 95% by weight of acrylonitrile/4% by weight of methyl acrylate/1% by weight of itaconic acid dissolved in the aqueous solution of zinc chloride in 7% by weight.

This solidified yarn was, as usual, washed with water, oiled, dried and stretched, and then passed through an interlacing nozzle at a pressurized-air outlet pressure of 50 kPa as a gauge pressure. Thus, there was provided a precursor fiber strand having an entanglement degree of 3.5 consisting of 24,000 acrylic precursor fibers having a fiber diameter of 9.0 μm.

This fiber strand was fed into a hot-air circulating oxidation oven with an inlet temperature (minimum temperature) of 230° C. and an outlet temperature (maximum temperature) of 250° C. while being oxidized in the hot air with a stretch ratio of 1.05. This oxidation oven had a temperature gradient in which a temperature gradually increases from an inlet toward an outlet. Thus, an acrylic oxidized fiber strand having a fiber density of 1.36 g/cm$^3$ and an entanglement degree of 5 was prepared. In this oxidation step, process stability was high and there are no troubles such as fluff formation and fiber twisting around a roll.

Next, the oxidized fiber strand was fed into a first carbonization oven where a temperature was gradually increased from an inlet temperature (minimum temperature) of 300° C. to an outlet temperature (maximum temperature) of 800° C. for conducting the first carbonization. The carbonation consists of the first stretching and the second stretching in an inert atmosphere.

The first stretching was conducted with a stretch ratio of 1.05 within the range 6 with a fiber elastic modulus continuing to increase as shown in FIG. 3. The first-stretched fibers after this first stretching had a single fiber elastic modulus of 8.8 GPa, a density of 1.40 g/cm$^3$ and a crystallite size of 1.20 nm, and yarn break was not observed.

Then, the first-stretched fibers were subjected to the second stretching in the first carbonization step. The second stretching was conducted within the range with a density continuing to increase and a crystallite size being 1.45 nm or less (FIGS. 4, 5). A stretch ratio was 1.00. This second stretching provided first-carbonized fibers with a density of 1.53 g/cm$^3$, an orientation degree of 77.1%, a fiber diameter of 6.8 μm and a fiber cross-section area of $3.63\times10^{-5}$ mm$^2$. In the first-carbonized fiber, yarn break was not observed.

Subsequently, the first-carbonized fibers were subjected to the first stretching and the second stretching under the conditions described below, using a second carbonization oven. The inside of the second carbonization oven was an inert atmosphere, and an inlet temperature (minimum temperature) was 800° C. and an outlet temperature (maximum temperature) was 1500° C. In the inside of the carbonization oven, a temperature was gradually increased in a gradient from the inlet to the outlet.

First, the first-carbonized fibers were stretched under the conditions of a fiber tension of 28.1 MPa, a fiber stress of 1.020 mN within the period that a density and a crystallite size were within the ranges of the first stretching shown in FIGS. 6 and 7, to provide first-stretched fibers. That is, as shown in FIG. 7, the stretching was conducted within the period that as a temperature rose, a density increased and reached the maximum value of 1.9 g/cm$^3$. Furthermore, as shown in FIG. 6, stretching was conducted within the period that as a temperature rose, a crystallite size first decreased and then began to increase to 1.47 nm.

Next, the first-stretched fibers were subjected to the second stretching in the second carbonization step. The stretching was conducted under the conditions of a fiber tension of 33.7 MPa and a fiber stress of 1.223 mN within the range for a density of the second stretching conditions shown FIG. 8, to provide second-carbonization fibers.

Then, the second-carbonization fibers were surface-treated with an electric quantity of 30 C per 1 g of carbon fibers, using an aqueous solution of ammonium sulfate as an electrolytic solution.

Subsequently, by a known method, a sizing agent (an epoxy resin) was added in 1.0% by weight as converted to a solid content and the product was dried. As a result, there was provided carbon fibers having a density of 1.77 g/cm$^3$, a fiber diameter of 5.1 μm, a strand tensile strength of 5,780 MPa and a strand tensile modulus of 319 GPa.

In the fiber surface, creases were observed and there was provided a carbon fiber strand having satisfactory physical properties such as a crease distance of 115 nm, a crease depth of 24 nm and a specific surface area of 0.65 m$^2$/g. This strand was evaluated for a strand width and strand splitting.

The above results are shown in Tables 1 to 3.

Comparative Example 1

Two spinnerets having 12,000 holes per spinneret were placed in parallel. To these two spinnerets was supplied the stock spinning solution used in Example 1 to eject the spinning solution into a solidification liquid (an aqueous solution of zinc chloride) for solidification. Thus, two solidified-yarn strands each of which consisted of 12,000 filaments were obtained. Next, these solidified-yarn strands were processed by the procedure including washing with water and the subsequent steps as described in Example 1, to provide two acrylic precursor fiber strands. These two strands were processed as described in Example 1, except that they were combined into one strand during the second carbonization.

The results are shown in Table 1. The carbon fiber strand thus obtained was evaluated for strand splitting, and strand splitting was observed.

Comparative Example 2

Processing was conducted as described in Comparative Example 1, except that two acrylic precursor fiber strands were combined into one strand before the first carbonization, to provide a carbon fiber strand. The results are shown in Table 1. The carbon fiber strand thus obtained was evaluated for strand splitting, and strand splitting was observed.

Comparative Example 3

Eight spinnerets having 3,000 holes per spinneret were placed. To these eight spinnerets was supplied the stock spinning solution used in Example 1 to eject the solution into a solidification liquid (an aqueous solution of zinc chloride) for solidification. Thus, eight solidified-yarn strands each of which consisted of 3,000 filaments were obtained. Next, these solidified-yarn strands were processed by the procedure including washing with water and the subsequent steps as described in Example 1, to provide eight acrylic precursor fiber strands. These eight strands were processed as described in Example 1, except that they were combined into one strand during the second carbonization.

The results are shown in Table 1. The carbon fiber strand thus obtained was evaluated for strand splitting, and strand splitting was observed.

Example 2

Processing was conducted as described in Example 1, except that in the interlacing, a pressurized-air blowing pressure of the interlacing nozzle was 30 kPa as a gauge pressure.

As a result, all of an entanglement degree of the precursor fiber strand, an entanglement degree of the oxidized fiber strand and stability of the oxidation step were satisfactory as shown in Table 2.

The carbon fibers obtained had a density of 1.77 g/cm$^3$, a fiber diameter of 5.1 μm, a strand tensile strength of 5,795 MPa and a strand tensile modulus of 319 GPa as shown in Table 3. In the fiber surface, creases were observed and there was provided a carbon fiber strand having satisfactory physical properties such as a crease distance of 114 nm, a crease depth of 24 nm and a specific surface area of 0.64 m$^2$/g. In this carbon fiber strand, strand splitting was not observed.

Comparative Example 4

Processing was conducted as described in Example 1, except that the precursor fiber strand was not interlaced.

As shown in Table 2, the precursor fiber strand had an entanglement degree of 2, and the oxidized fiber strand had an entanglement degree of 4, and the oxidization step was unstable.

Comparative Example 5

Processing was conducted as described in Example 1, except that in the interlacing of the precursor fiber strand obtained in Example 1, a pressurized-air blowing pressure of the interlacing nozzle was 10 kPa as a gauge pressure. As shown in Table 2, the precursor fiber strand had an entanglement degree of 2 and the oxidized fiber strand had an entanglement degree of 4. In the oxidation step, the strand was excessively fiber-opened, and the oxidation step was unstable.

Comparative Example 6

Processing was conducted as described in Example 1, except that in the interlacing of the precursor fiber strand obtained in Example 1, a pressurized-air blowing pressure of the interlacing nozzle was 70 kPa as a gauge pressure. As shown in Table 2, the precursor fiber strand had an entanglement degree of 5 and the oxidized fiber strand had an entanglement degree of 10, and the carbon fibers obtained had low strength.

Example 3

Processing was conducted as described in Example 1, except that the maximum temperature in the second carbonization for the first-carbonized fibers obtained in Example 1 was 1,700° C. and an electric quantity per 1 g of carbon fibers in the surface oxidation of the second-carbonized fibers was 80 C.

The results are shown in Table 3.

Example 4

Processing was conducted as described in Example 1, except that the maximum temperature in the second carbonization for the first-carbonized fibers obtained in Example 1 was 1,400° C. and an electric quantity per 1 g of carbon fibers in the surface oxidation of the second-carbonized fibers was 25 C. The results are shown in Table 3.

Comparative Example 7

Processing was conducted as described in Example 1, except that an electric quantity per 1 g of carbon fibers in the surface oxidation of the second-carbonized fibers was 15 C.

The results are shown in Table 3. The strand was defective in all of a carbon fiber (CF) strength, a crease depth in the carbon fiber surface and a specific surface area, and thus, a carbon fiber strand having satisfactory physical properties was not obtained.

Comparative Example 8

Processing was conducted as described in Example 1, except that the maximum temperature in the second carbonization for the first-carbonized fibers obtained in Example 1 was 1,350° C. and an electric quantity per 1 g of carbon fibers in the surface oxidation of the second-carbonized fibers was 25 C.

The results are shown in Table 3. The strand was defective in all of a CF elastic modulus, a crease distance in the carbon fiber surface and a crease depth in the surface, and thus, a carbon fiber strand having satisfactory physical properties was not obtained.

Comparative Example 9

Processing was conducted as described in Example 1, except that the stretching in the first carbonization consisted of the first stretching alone.

The results are shown in Table 3. The strand had an insufficient CF strength, and a carbon fiber strand having satisfactory physical properties was not obtained.

Comparative Example 10

Processing was conducted as described in Example 1, except that the stretching in the first carbonization consisted of the second stretching alone. The results are shown in Table 3. The strand had an insufficient CF strength, and a carbon fiber strand having satisfactory physical properties was not obtained.

TABLE 1

| | Filament number (spinneret number) | Interlacing pressure (kPa) | Place of strand combination | Strand width | Strand splitting number | Stability of the oxidation step |
|---|---|---|---|---|---|---|
| Example 1 | 24,000H (one) | 50 | — | 6 mm | 0 | High |
| Example 2 | 24,000H (one) | 30 | — | 7 mm | 0 | High |
| Example 3 | 24,000H (one) | 50 | — | 6 mm | 0 | High |
| Example 4 | 24,000H (one) | 50 | — | 6 mm | 0 | High |
| Comparative Example 1 | 12,000H (two) | 50 | During carbonization | 7 mm | 1 | High |
| Comparative Example 2 | 12,000H (two) | 50 | Before carbonization | 7 mm | 1 | High |
| Comparative Example 3 | 3,000H (eight) | 50 | During carbonization | 8 mm | 2 | High |
| Comparative Example 4 | 24,000H (one) | 0 | — | 7.5 mm | 0 | Low |
| Comparative Example 5 | 24,000H (one) | 10 | — | 7.5 mm | 0 | Low |
| Comparative Example 6 | 24,000H (one) | 70 | — | 5 mm | 0 | High |
| Comparative Example 7 | 24,000H (one) | 50 | — | 6 mm | 0 | High |

TABLE 2

| | Interlacing | Interlacing pressure (kPa) | Entanglement degree of a precursor fiber strand | Stability of the oxidation step | Entanglement degree of oxidized fibers | Strand width | Dry fiber after resin impregnation |
|---|---|---|---|---|---|---|---|
| Example 1 | Done | 50 | 3.5 | High | 6 | 6 mm | Not observed |
| Example 2 | Done | 30 | 3 | High | 5 | 7 mm | Not observed |
| Example 3 | Done | 50 | 3.5 | High | 6 | 7 mm | Not observed |
| Example 4 | Done | 50 | 3.5 | High | 6 | 7 mm | Not observed |
| Comparative Example 4 | Not done | 0 | 2 | Low | 4 | 7.5 mm | Not observed |
| Comparative Example 5 | Done | 10 | 2 | Low | 4 | 7.5 mm | Not observed |
| Comparative Example 6 | Done | 70 | 5 | High | 10 | 5 mm | Observed |

TABLE 3

| | Stretching in the first carbonization | Tension control in the second carbonization | Maximum temperature in the second carbonization (° C.) | Surface treatment (C/g) | CF strength (MPa) | CF elastic modulus (GPa) | CF density (g/cm$^3$) | Crease distance (nm SPM) | Crease depth (nm SPM) | Specific surface area (m$^2$/g) |
|---|---|---|---|---|---|---|---|---|---|---|
| Example 1 | First + second | Second | 1,500 | 30 | 5,780 | 319 | 1.77 | 115 | 24 | 0.65 |
| Example 2 | First + second | Second | 1,500 | 30 | 5,795 | 319 | 1.77 | 114 | 24 | 0.64 |
| Example 3 | First + second | Second | 1,700 | 80 | 5,680 | 338 | 1.76 | 117 | 26 | 0.7 |
| Example 4 | First + second | Second | 1,400 | 25 | 5,830 | 309 | 1.78 | 110 | 23 | 0.63 |
| Comparative Example 7 | First + second | Second | 1,500 | 15 | 5,530 | 319 | 1.77 | 100 | 19 | 0.59 |
| Comparative Example 8 | First + second | Second | 1,350 | 25 | 6,070 | 294 | 1.8 | 93 | 18 | 0.61 |
| Comparative Example 9 | First alone | Second | 1,500 | 30 | 5,480 | 319 | 1.77 | 113 | 25 | 0.64 |
| Comparative Example 10 | Second alone | Second | 1,500 | 30 | 5,390 | 317 | 1.76 | 114 | 23 | 0.62 |

The invention claimed is:

1. A carbon fiber strand comprising of a bundle of 20,000 to 30,000 carbon fibers, each of which has in the surface thereof, a plurality of creases parallel to the fiber-axis direction of the carbon fiber and in which as measured by scanning probe microscopy, an inter-crease distance in the surface of said carbon fiber is 100 to 119 nm, a crease depth in the surface is 23 to 30 nm, an average fiber diameter is 4.5 to 6.5 μm, a specific surface area is 0.6 to 0.8 m$^2$/g and a density is 1.76 g/cm$^3$ or more, wherein said carbon fiber strand has a strand tensile strength of 5,650 MPa or more and a strand tensile modulus of 300 GPa or more; a strand wound with a predetermined tension has a strand width of 5.5 mm or more; and no strand splittings are observed in a strand splitting evaluation method where a predetermined tension is applied to a running carbon fiber strand.

2. A process for producing the carbon fiber strand as claimed in claim 1, comprising passing a solidified-yarn strand prepared by spinning a stock spinning solution using a spinneret having 20,000 to 30,000 spinning holes through an interlacing nozzle at a pressurized-air blowing pressure of 20 to 60 kPa as a gauge pressure to provide a precursor fiber strand; then oxidizing said precursor fiber strand in hot air at 200 to 280° C. to provide an oxidized fiber strand; conducting first carbonization by first stretching said oxidized fiber strand with a stretch ratio of 1.03 to 1.06 at a temperature of 300 to 900° C. in an inert-gas atmosphere and then second stretching with a stretch ratio of 0.9 to 1.01; then, conducting second carbonization at a temperature of 1,360 to 2,100° C. in an inert-gas atmosphere; and then, oxidizing the surface of the carbon fiber strand obtained after said carbonization, by electrolytic oxidation with an electric quantity of 20 to 100 C per 1 g of the carbon fibers in an aqueous solution of an inorganic acid salt.

3. The process for producing a carbon fiber strand as claimed in claim 2, wherein said stock spinning solution is an aqueous solution of zinc chloride or a solution of an acrylic polymer in an organic solvent.

* * * * *